US005702047A

United States Patent [19]

Yoshie

[11] Patent Number: 5,702,047

[45] Date of Patent: Dec. 30, 1997

[54] ELECTRIC STAPLER

[75] Inventor: Toru Yoshie, Tokyo, Japan

[73] Assignee: Max Co., Ltd., Tokyo, Japan

[21] Appl. No.: 607,367

[22] Filed: Feb. 27, 1996

[30] Foreign Application Priority Data

Feb. 28, 1995 [JP] Japan ..... 7-064985

[51] Int. Cl.[6] ..... B65H 37/04

[52] U.S. Cl. ..... 227/131; 227/120; 227/136; 227/138; 227/2

[58] Field of Search ..... 227/120, 131, 227/136, 138, 2, 5

[56] References Cited

U.S. PATENT DOCUMENTS

| | | | |
|---|---|---|---|
| 4,978,045 | 12/1990 | Murakami et al. | 227/120 |
| 5,009,355 | 4/1991 | Akizawa et al. | 227/131 |
| 5,230,457 | 7/1993 | Hiroi et al. | 227/2 |
| 5,342,033 | 8/1994 | Iwata et al. | 227/2 |
| 5,460,313 | 10/1995 | Magnusson et al. | 227/131 |
| 5,460,314 | 10/1995 | Udagawa | 227/131 |

FOREIGN PATENT DOCUMENTS

| | | |
|---|---|---|
| 4-129679 | 4/1992 | Japan . |
| 7-215574 | 8/1995 | Japan . |

*Primary Examiner*—Joseph J. Hail, III
*Assistant Examiner*—Jay A. Stelacone
*Attorney, Agent, or Firm*—Jacobson, Price, Holman & Stern, PLLC

[57] ABSTRACT

An electric stapler is provided which comprises a driving plate (7) for driving out a staple from a driving position while reciprocating, a delivering mechanism for delivering a sheet-staple (11) to the driving position interrelatedly with a reciprocating motion of the driving plate, a working piece (24) which is rotated by a push given by a staple occupying the front row of the sheet-staple (11) when the front staple reaches the driving position, and a sensor (25) for detecting the rotation of the working piece (24). The driving plate (7) returns to its initial position in accordance with a detection signal output by the sensor (25).

12 Claims, 4 Drawing Sheets

ELECTRIC STAPLER

BACKGROUND OF THE INVENTION

1. Field of the Invention

This invention relates to an electric stapler in which, when a sheet-staple is first set, the sheet-staple is delivered to a predetermined position to be actually driven out.

2. Description of the Prior Art

An electric stapler is known as described in Japanese Patent Application Early Laid-Open Publication No. Hei 4-129679. In this conventional electric stapler, a sheet-staple consisting of straight wires arranged like a sheet of paper is delivered to a predetermined position under a forming plate and a driving plate. The wires of the sheet-staple are then formed U-shaped by the forming plate, and the U-shaped staples are each driven into, for example, sheets of paper to be fastened together by the driving plate.

A delivering mechanism for delivering the sheet-staple to the predetermined position is constructed to operate interrelatedly with a reciprocating motion of the forming and driving plates. In an electric stapler provided with the delivering mechanism, when the sheet-staple is first set in the electric stapler, a staple driving operation without driving out a staple (this operation will be referred to as a "blank shot" in the following) is carried out several times in order to deliver the sheet-staple to the predetermined position. In addition, for example, after staples or a sheet staple has been removed from the predetermined position in order to restore anomalous stapling to the normal condition, the blank shot is repeated to deliver another sheet-staple to the predetermined position so that staples of the sheet-staple are ready to be actually driven out and into the sheets of paper.

However, the number of times up to which the blank shot is repeated depends on the location of staples or a sheet staple or depends on the type of a stapler to be used. Accordingly, in an electric stapler by which sheets of copying paper duplicating the pages of original written material by means of a copy machine are automatically fastened together to make pamphlets, cases occur in which some of the pamphlets produced thereby are much inferior in stapling or in which staples driven out by accident during the blank shot are left on a clincher of the stapler even if the blank shot is repeated up to the predetermined number of times.

In addition, disadvantageously, since the blank shot is carried out in contact with the paper, traces remain on the paper which show that the blank shot has been carried out on the paper several times although there is an electric stapler provided with an ascertaining mechanism disposed on the side of a clincher for ascertaining a state in which a staple is ready to be actually driven out.

SUMMARY OF THE INVENTION

It is an object of the present invention to provide an electric stapler which is capable of, when a sheet-staple is set or when anomalous stapling is restored, certainly bringing about a state in which a staple is ready to be driven out and which is capable of performing a blank shot entirely without driving out a staple.

A feature of the present invention is that, in an electric stapler comprising a driving plate for driving out a staple from a driving position while reciprocating, and a delivering means for delivering an array of staples to the driving position interrelatedly with a reciprocating motion of the driving plate, a detecting means is provided for detecting that a staple occupying the front row of the array of the staples has reached the driving position, and the driving plate returns to an initial position in accordance with a detection signal output by the detecting means.

DETAILED DESCRIPTION OF THE DRAWINGS

DETAILED DESCRIPTION OF THE EMBODIMENT

Figure 1:
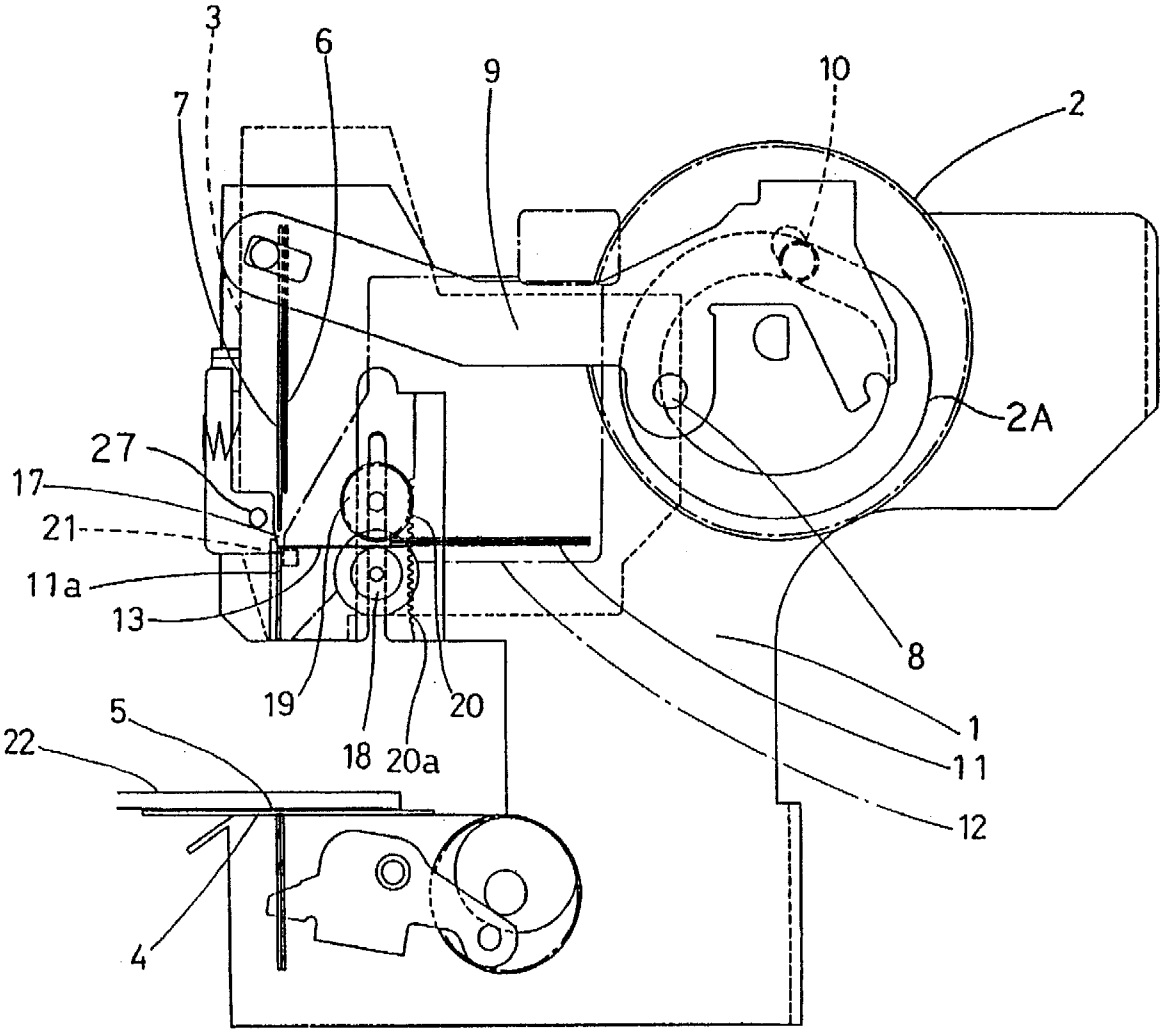
FIG. 1 is a schematic view of an electric stapler according to the present invention, the electric stapler being in a state prior to starting a stapling operation.

FIG. 1 is a schematic view of an electric stapler according to the present invention. A grooved cam 2 with a groove 2A is rotatably mounted in a rear part of a frame 1 of the electric stapler. The grooved cam 2 is rotated by an electric motor (not shown). A magazine 3 is mounted in a front part of the frame 1, and a stapling base 4 is mounted in a front lower part of the frame 1. A clincher 5 is mounted on the stapling base 4.

In a front part of the magazine 3, a forming plate 6 and a driving plate 7 which are placed upon each other are held by a holder (not shown). A driving link 9 is rotatably mounted on a supporting shaft 8 (not shown) of the frame 1. A front end of the driving link 9 is engaged with the holder, and a roller 10 disposed at a rear part of the driving link 9 is engaged with the groove 2A of the grooved cam 2.

Because of these engagements, the rotation of the grooved cam 2 by the electric motor brings about a reciprocating motion of the driving link 9, thereby bringing about an up-and-down reciprocating motion of the forming and driving plates 6, 7. At the same time, the magazine 3 is moved in the up-and-down direction.

A cartridge 12 is mounted in the magazine 3. The cartridge 12 contains a pile of sheet-staples 11 each of which consists of straight wires arranged side by side like a sheet of paper. A discharge opening (not shown) is formed in a lower part of a front wall of the cartridge 12. The sheet-staples are discharged from the discharge opening in ascending order of the piled-up sheet-staples, in other words, the lowest one of the sheet-staples is discharged in turn from the discharge opening and is delivered along a staple guide 13 to a forming and driving portion 17 formed under the forming and driving plates 6, 7.

A delivering means for delivering the sheet-staples 11 comprises a delivering roller 18 disposed under the staple guide 13, a pinion gear 19 meshed with the delivering roller 18, and a rack 20 meshed with the pinion gear 19. The delivering roller 18 and the pinion gear 19 are mounted in the magazine 3, and the rack 20 is formed on the frame 1.

Figure 2:
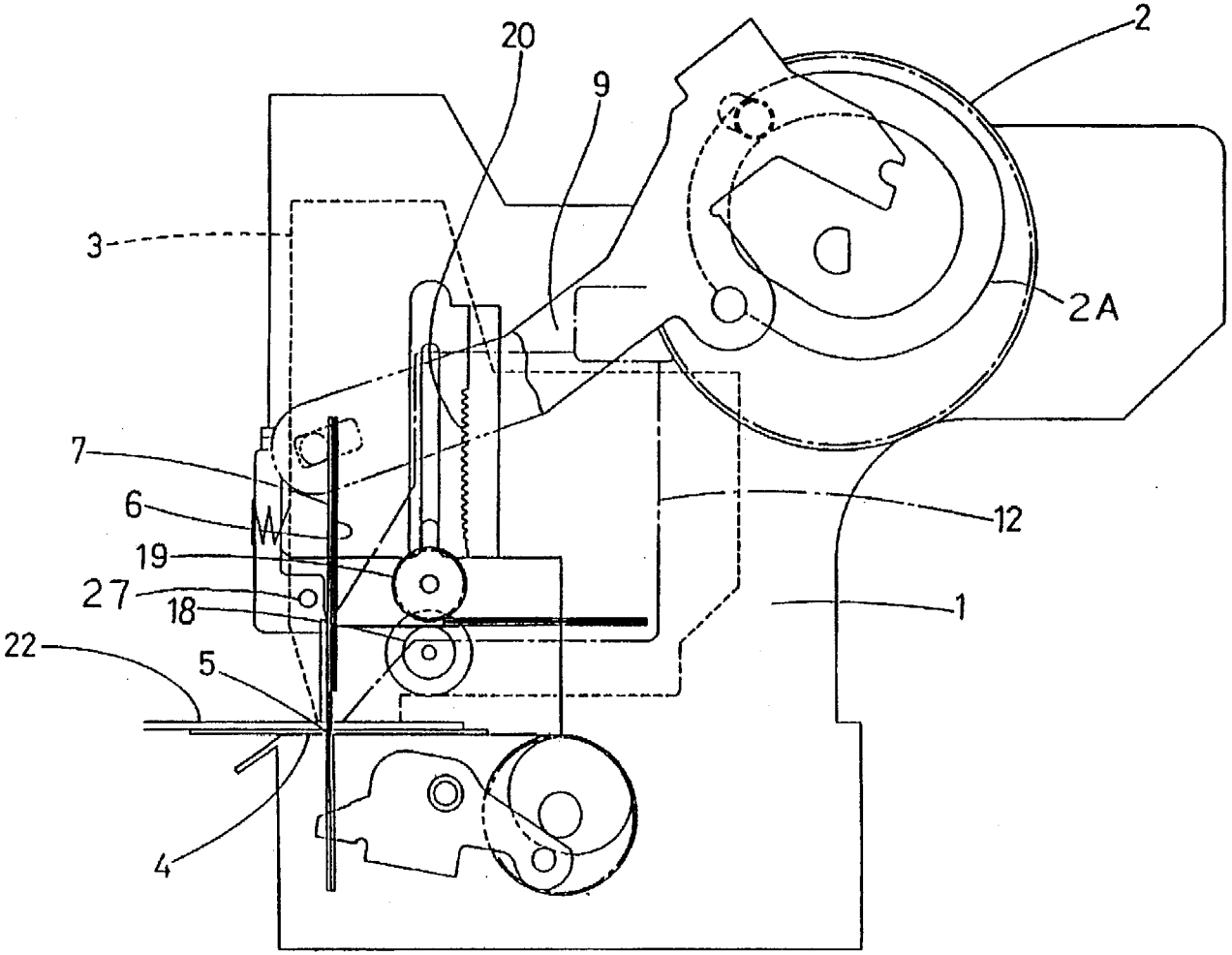
FIG. 2 is a schematic view of the electric stapler performing the stapling operation.

When the magazine 3 is moved upward together with the forming and driving plates 6, 7, the pinion gear 19 is rotated, as shown in FIG. 2, along the rack 20 interrelatedly with the upward motion of the magazine 3. At the same time, the delivering roller 18 engaging with the pinion gear 19 is rotated counterclockwise (in FIG. 1). Since the delivering roller 18 is in contact with the back surface of the lowest one of the sheet-staples 11 contained in the cartridge 12, the lowest sheet-staple 11 is discharged from the discharge opening in accordance with the counterclockwise rotation of the delivering roller 18 and is delivered to the forming and driving portion 17 along the staple guide 13.

When the magazine 3 is moved downward, the pinion gear 19 comes out of mesh with the rack 20 before the magazine 3 reaches its lowest position. When the pinion gear 19 which is out of mesh with the rack 20 is moved upward, the pinion gear 19 is again meshed with the rack 20. In order to facilitate the re-mesh therebetween, the lower part 20*a* of the rack 20 is formed such that the height of its teeth gradually becomes shorter. The pinion gear 19 is brought into mesh with the rack 20 and is reversely rotated when the magazine 3 is moved downward, whereas the delivering roller 18 is formed not to be reversely rotated with the aid of a clutch mechanism.

Figure 3:
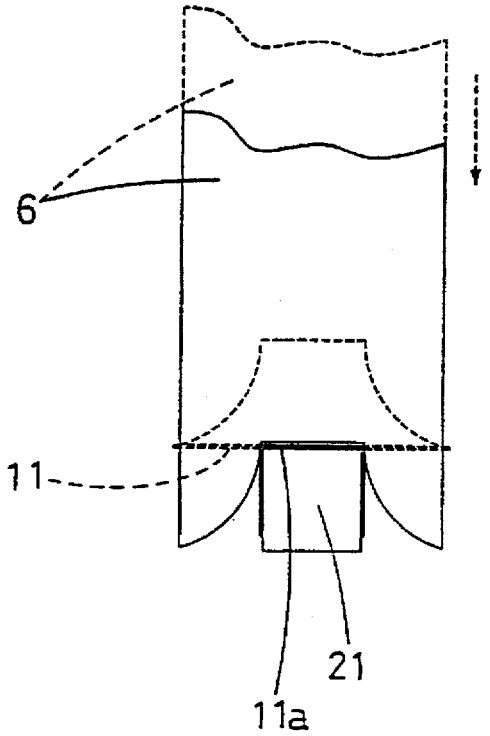
FIG. 3(*a*) is a descriptive drawing showing that the electric stapler is forming a U-shaped staple, and FIG. 3(*b*) is a descriptive drawing showing that the electric stapler is driving the U-shaped staple into sheets of paper.
Figure 3:
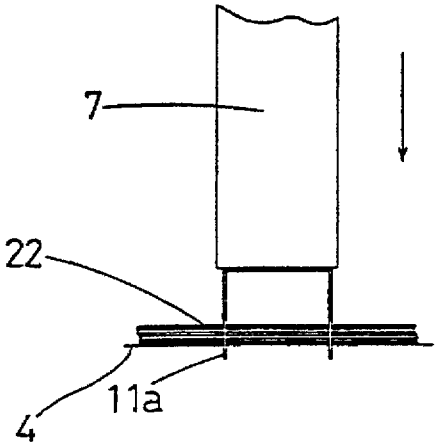

An anvil 21 is disposed under the forming plate 6 at a forming side of the forming and driving portion 17. By moving the forming plate 6 downward, both ends of a staple 11*a* occupying the front row of the sheet-staple 11 on the anvil 21 are bent and thereby the staple 11*a* is formed U-shaped as shown in FIG. 3(*a*). When the forming plate 6 is moved upward, the U-shaped staple 11*a* is pushed by a pusher (not shown) toward a driving side of the forming and driving portion 17. The forming and driving sides of the forming and driving portion 17 are contiguous to each other. In FIG. 1, the forming side is at the right of the forming and driving portion 17, and the driving side is at the left thereof.

As shown in FIG. 3(*b*), when the driving plate 7 is moved downward, the U-shaped staple 11*a* is driven out and into the sheets of paper 22 to be fastened together which are put on the stapling base 4. Legs of the U-shaped staple 11*a* which have passed through the sheets 22 are clinched, and thereby the stapling is completed.

Since there is a distance corresponding to about half the length of the sheet-staple 11 between the discharge opening of the cartridge 12 and the forming and driving portion 17, the front staple 11*a* of the sheet-staple 11 can reach the forming side of the forming and driving portion 17 by repeating the up-and-down motion of the magazine 3 several times after the lowest one of the piled sheet-staples 11 has been discharged from the discharge opening of the cartridge 12.

Figure 4:
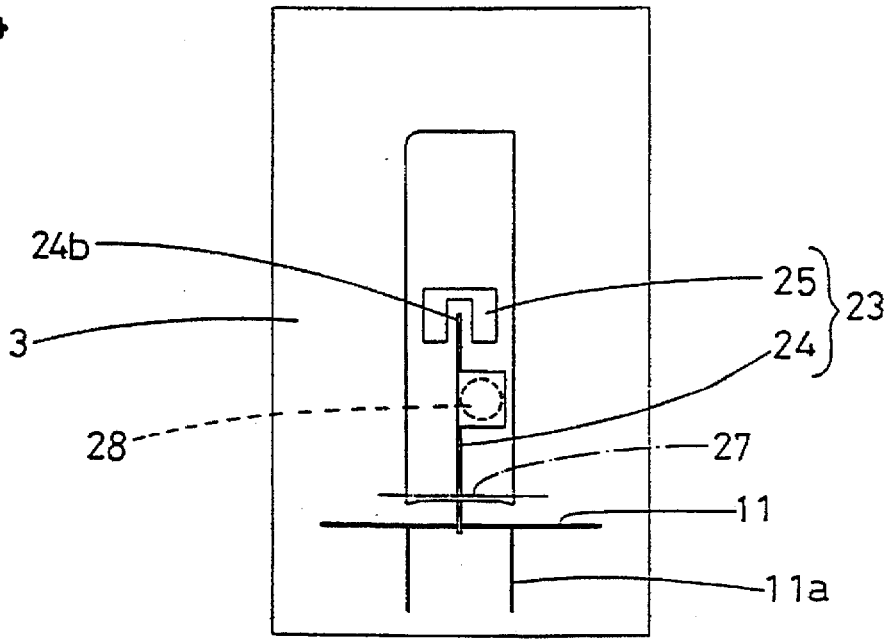
FIG. 4 is a front schematic view of the electric stapler.
Figure 5A:
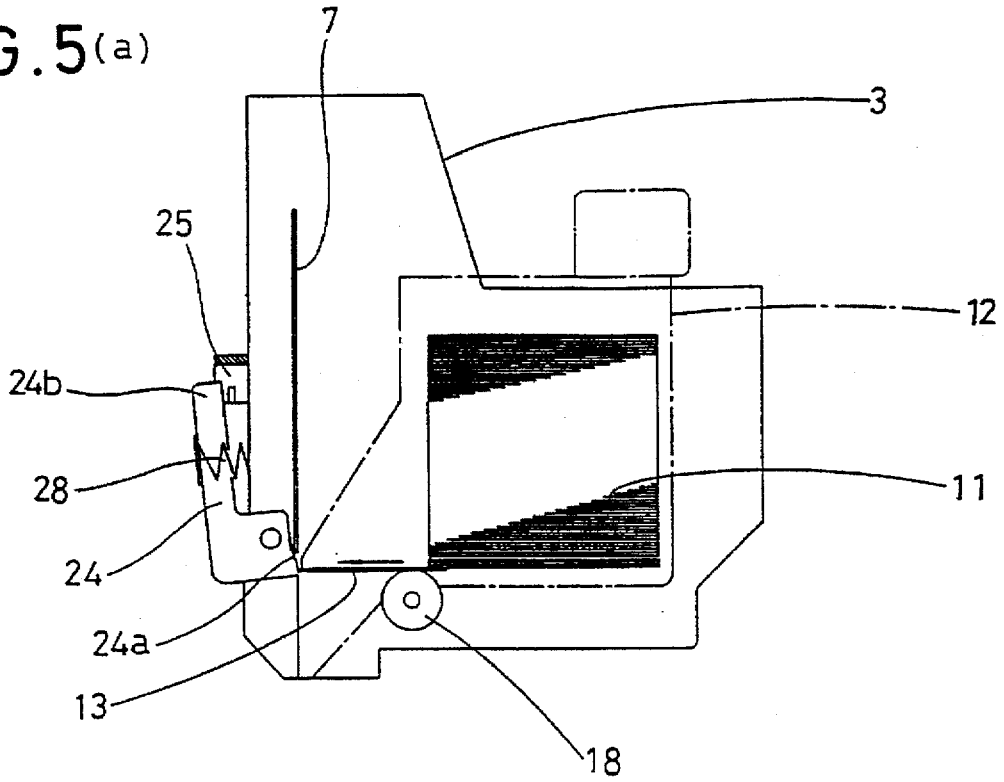
FIG. 5(*a*) is a descriptive drawing showing that the electric stapler is in a state in which a staple is not ready to be driven out yet, and FIG. 5(*b*) is a descriptive drawing showing that the staple is ready to be driven out.
Figure 5B:
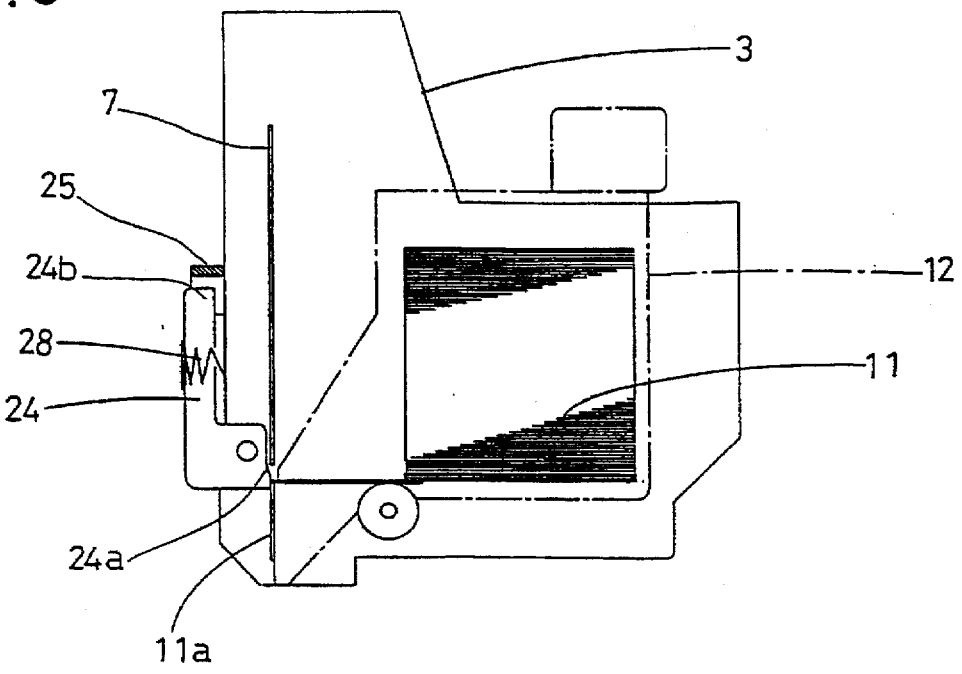

As shown in FIGS. 4, 5(*a*), and 5(*b*), at the front of the magazine 3, a detecting means 23 is provided for detecting that the front staple 11*a* of the sheet-staple 11 delivered by the delivering means has reached the driving side or the forming and driving portion 17.

The detecting means 23 comprises a working piece 24 and a sensor 25 for detecting a displacement of the working piece 24. The working piece 24 is rotatably fixed to a shaft 27 disposed horizontally with respect to the front wall of the magazine 3 (in FIG. 4). A distance between the shaft 27 and the upper end (rear end) 24*b* of the working piece 24 is set to be longer than a distance between the shaft 27 and the lower end (front end) 24*a* thereof.

In addition, the working piece 24 is designed to be rotated counterclockwise (in FIGS. 5(*a*) and 5(*b*)) by means of a compression spring 28. Due to the force of the compression spring 28, the upper end of the working piece 24 always slopes forwards as shown in FIG. 5(*a*), whereas the rear surface of the lower end 24*a* is situated at the driving side of the forming and driving portion 17. The force of the compression spring 28 is predetermined such that the working piece 24 is pressed by the front staple 11*a* and is rotated clockwise when the front staple 11*a* reaches the driving side.

The sensor 25 detects a displacement of the working piece 24 by sensing the upper end 24*b* of the working piece 24. The sensor 25 is, for example, a photosensor, The sensor 25 is designed not to sense the upper end 24*b* of the working piece 24 when the working piece 24 is in a state shown in FIG. 5(*a*), and is designed to sense the upper end 24*b* when the working piece 24 is in a state shown in FIG. 5(*b*). Instead of the sensor 25, another type of sensor or a microswitch may be used if it can detect a displacement of the working piece 24. A detection signal output by the sensor 25 is input to a control circuit (not shown). The control circuit controls the electric motor in accordance with the detection signal or a stapling signal output by, for example, a copy machine.

The operation of the electric stapler thus constructed will now be described.

When sheet-staples are first set without any trouble or when staples or sheet-staples are removed which have been used for anomalous stapling, the electric motor is actuated by the control circuit. Following this actuation, the grooved cam 2 is rotated, and thereby the forming and driving plates 6, 7 reciprocate up and down. By this reciprocation motion, the forming and driving plates 6, 7 successively perform a blank shot (i.e., a forming and driving operation without driving out a staple).

On the other hand, the magazine 3 continues to reciprocate up and down interrelatedly with the motion of the forming and driving plates 6, 7. By this reciprocation of the magazine 3, a sheet-staple 11 is delivered to the forming side of the forming and driving portion 17 by means of the delivering roller 18.

The front staple 11*a* of the sheet-staple 11 which has reached the forming side is formed U-shaped by means of the forming plate 6, and then is pushed to the driving side of the forming and driving portion 17. At this time, the rear surface of the lower part 24*a* of the working piece 24 is also pressed forwards, and accordingly the working piece 24 is rotated clockwise (in FIG. 5(*b*)) against the force of the compression spring 28.

Since s distance between the shaft 27 and the upper end 24*b* of the working piece 24 is set to be longer than a distance between the shaft 27 and the lower end 24*a* thereof, the upper end 24*b* is greatly moved from a position shown in FIG. 5(*a*) to a position shown in FIG. 5(*b*). Accordingly, the sensor 25 senses the upper end 24*b* certainly, thereby detecting a displacement of the working piece 24.

After the forming and driving plates 6, 7 return to the initial position shown in FIG. 1, the control circuit stops the electric motor on condition that the sensor 25 has output a detection signal. Since the staple 11*a* has been already placed at the driving side of the forming and driving portion 17, the electric stapler is in a state in which the staple 11*a* is ready to be actually driven out and into the sheets of paper. After that, stapling is carried out.

Since the control circuit actuates the electric motor to perform a blank shot required number of times until the state for actual driving is obtained, an operator can await without putting sheets of paper to be fastened together on the stapling base 4 during this preparatory process. Therefore, traces do not remain on the paper which show that the blank shot has been carried out on the paper. Additionally, since U-shaped staples are certainly driven into the sheets after obtaining the state for actual driving, any pamphlet made with the U-shaped staples is perfect in stapling.

In addition, since the electric motor is stopped when the front staple 11*a* of the sheet-staple 11 reaches the driving side of the forming and driving portion 17, the front staple 11*a* is not driven out while the blank shot is being repeated, and therefore cases do not occur in which staples 11*a* are disadvantageously left on the clincher.

When the staple 11*a* is pushed to the driving side of the forming and driving portion 17, the electric motor is driven until the forming and driving plates 6, 7 reach their initial state. However, only when the forming and driving plates 6, 7 are moved upward, the sheet-staple is delivered to the driving side of the forming and driving portion 17, and therefore cases do not occur in which a staple 11*a* is driven out during the time between the output of a detection signal by the sensor 25 and the return of the forming and driving plates 6, 7 to the initial state, In the above embodiment, stapling is carried out by the use of a sheet-staple. Instead, another type of electric stapler may be provided in which use is made of an array of staples formed U-shaped beforehand.

What is claimed:

1. An electric stapler comprising:

a driving plate for driving out a staple from a driving position while reciprocating;

delivering means for delivering an array of staples to the driving position interrelatedly with a reciprocating motion of said driving plate; and detecting means for detecting that a staple occupying a front row of the array of the staples has reached the driving position;

wherein said driving plate returns to an initial position in accordance with a detection signal output by said detecting means.

2. An electric stapler according to claim 1, further comprising a forming plate placed upon said driving plate;

wherein the array of the staples is a sheet of staples arranged like a sheet of paper, and the front staple thereof is movable to a place under said driving plate only after the front staple has been formed into a definite shape by means of said forming plate.

3. An electric stapler according to claim 1, wherein said detecting means comprises a working piece and a sensor for detecting rotation of said working piece, said working piece being rotated by a push given by the front staple when the front staple reaches the driving position.

4. An electric stapler according to claim 3, wherein one end of said working piece is provided with a contact segment with which the front staple comes into contact, and said sensor detects a position of the other end of said working piece.

5. An electric stapler according to claim 4, wherein said working piece is rotatable on a shaft, and a distance between said shaft and said one end of said working piece is set to be shorter than a distance between said shaft and said other end of said working piece.

6. An electric stapler according to claim 1, further comprising a forming plate placed upon said driving plate;

wherein the array of the staples is a sheet of staples arranged like a sheet of paper, and the front staple thereof is movable to a place under said driving plate only after the front staple has been formed into a definite shape by means of said forming plate.

7. An electric stapler according to claim 6, wherein said detecting means comprises a working piece and a sensor for detecting rotation of said working piece, said working piece being rotated by a push given by the front staple when the front staple reaches the driving position.

8. An electric stapler according to claim 7, wherein one end of said working piece is provided with a contact segment with which the front staple comes into contact, and said sensor detects a position of the other end of said working piece.

9. An electric stapler according to claim 8, wherein said working piece is rotatable on a shaft, and a distance between said shaft and said one end of said working piece is set to be shorter than a distance between said shaft and said other end of said working piece.

10. An electric stapler comprising:

a driving plate for driving out a staple from a driving position while reciprocating;

delivering means for delivering an array of staples to the driving position interrelatedly with a reciprocating motion of said driving plate;

detecting means for detecting that a staple occupying a front row of the array of the staples has reached the driving position; and control means for, when said detecting means detects that the front staple has reached the driving position, returning said driving plate to an initial position so as to prevent a wasteful blank shot or a wasteful driving operation.

11. An electric stapler comprising:

a driving plate for driving out a staple from a driving position while reciprocating;

delivering means for delivering an array of staples to the driving position interrelatedly with a reciprocating motion of said driving plate;

detecting means for detecting that a staple occupying a front row of the array of the staples has reached the driving position; and control means for, when said detecting means detects that the front staple has reached the driving position, returning said driving plate to an initial position;

wherein said detecting means comprises a working piece and a sensor for detecting a position of a rear end of said working piece, said working piece being rotated on a shaft when the front staple reaches the driving position; a front end of said working piece is provided with a contact segment with which the front staple comes into contact; and a distance between said shaft and said front end of said working piece is set to be shorter than a distance between said shaft and said rear end of said working piece, so that a displacement of said working piece is accurately detected.

12. An electric stapler according to claim 11, further comprising a forming plate placed upon said driving plate;

wherein the array of the staples is a sheet of staples arranged like a sheet of paper, and the front staple thereof is movable to a place under said driving plate only after the front staple has been formed into a definite shape by means of said forming plate.

* * * * *